US005714710A

United States Patent [19]

Roach

[11] Patent Number: 5,714,710

[45] Date of Patent: Feb. 3, 1998

[54] TWO PART PROPELLANT CHANGE WITH MEANS FOR CONNECTING THEM TOGETHER

[75] Inventor: Graham Richard Roach, Farnborough, Great Britain

[73] Assignee: The Secretary of State for Defence in Her Britannic Majesty's Government of the United Kingdom of Great Britain and Northern Ireland, Hants, United Kingdom

[21] Appl. No.: 619,661

[22] PCT Filed: Mar. 6, 1995

[86] PCT No.: PCT/GB95/00470

§ 371 Date: Aug. 28, 1996

§ 102(e) Date: Aug. 28, 1996

[87] PCT Pub. No.: WO95/24605

PCT Pub. Date: Sep. 14, 1995

[30] Foreign Application Priority Data

Mar. 7, 1994 [GB] United Kingdom ..... 9404333

[51] Int. Cl.[6] ..... F42B 5/00

[52] U.S. Cl. ..... 102/282; 102/431; 102/443; 102/464

[58] Field of Search ..... 102/282, 317, 102/331, 373, 377, 430, 431, 432, 433, 434, 443, 464–468, 700

[56] References Cited

U.S. PATENT DOCUMENTS

| | | | |
|---|---|---|---|
| 5,193,702 | 3/1993 | Shannon . | |
| 5,353,710 | 10/1994 | Eches et al. | 102/443 |

FOREIGN PATENT DOCUMENTS

| | | | |
|---|---|---|---|
| 0502753 | 9/1992 | European Pat. Off. . | |
| 2284853 | 4/1976 | France | 102/466 |
| 2261223 | 8/1974 | Germany . | |
| 8804573 | 8/1989 | Germany . | |
| 36498 | 10/1959 | Luxembourg . | |
| 115870 | 12/1968 | Norway | 102/443 |
| 344357 | 3/1960 | Switzerland . | |
| 2194024 | 2/1988 | United Kingdom . | |
| WO93/16350 | 8/1993 | WIPO . | |

*Primary Examiner*—Harold J. Tudor
*Attorney, Agent, or Firm*—Nixon & Vanderhye P.C.

[57] ABSTRACT

Ammunition round comprising a primary cartridge (1) and a secondary cartridge (2) provided with mutually cooperable push fit connection means for connecting the two cartridges during loading. The cartridges (1, 2) incorporate sockets (10, 12) which contain and are connected by a connecting piece (14). Socket (12) includes a cavity (20) having sufficient longitudinal depth to allow some axial movement of the connecting piece (14) ensuring that strain on the connecting piece (14) during loading is minimized.

14 Claims, 2 Drawing Sheets

TWO PART PROPELLANT CHANGE WITH MEANS FOR CONNECTING THEM TOGETHER

The present invention relates to two part ammunition rounds comprising two separate cartridges provided with connectors.

In recent times there have been substantial improvements in the effectiveness of armour arrays, and to counter these improvements corresponding improvements are required in the performance of solid propellant gun/ammunition systems, and especially tank gun systems for main battle tanks. This is often achieved mainly by a combination of significant increases in propellant charge weight and the use of very long penetrators so as to deliver the increased kinetic energy per unit area necessary to defeat such advanced armour arrays. If rounds with these increased propellant charge weights are to be compatible with existing main battle tank designs, constraints are placed on the maximum diameter for the ammunition round and thus, to accommodate the increased propellant, total round lengths must increase.

There is a requirement in many existing main battle tank systems that at least half its ammunition load should be carried in hull stowage. In order to facilitate such stowage of these longer rounds within the vehicle and also the handling of the round in use it is common to split the round into two or more parts. Where the round is in two parts some propelling charge is contained along with the projectile in one cartridge and the remaining propellant is contained within a second cartridge. The latter is usually referred to as the primary cartridge, and is located to the rear of the other cartridge (the secondary cartridge) when the round is loaded.

Such a round may be loaded by using the primary cartridge to push the secondary cartridge into a gun barrel. However, only the primary cartridge can be readily unloaded in this case, with the secondary cartridge only being removable in practice by pushing through the muzzle, so that such a system is unsuitable where rapid unloading of the whole round may be desired. It is desirable therefore for the ammunition round to be provided with interengagement means for connecting the front end of the primary cartridge to the rear end of the secondary cartridge. It is particularly desirable that such interengagement means can be used with an autoloader system for rapid operation in the field.

DE-U-8804573 discloses an interconnection means for modular propellant charges comprising tongues which fit under each other. However, the connection means involves rotating the charges relative to one another which would be unsuitable for use in an autoloader.

The main battle tank application imposes a general requirement for connection means which can be operated rapidly and withstand the strains produced by the high ramming stresses encountered in loading main battle tank guns, particularly via an autoloader. UK patent No 2194024 discloses combustible cases with integrally moulded joining means. However, the combustible case material used is relatively weak so that such an arrangement is susceptible to deformation damage under the ramming stresses imposed by rapid loading, especially if an autoloader is used. A nested interconnection means having electrical contacts for propagation of an ignition signal is disclosed in WO-A-93/16350. However, the high stresses of rapid loading would lead to a likelihood of damage to the connectors.

Furthermore, in a typical system, when the rearward (primary) cartridge is brought to a halt by contact of its rear case rim with the barrel chamber face, tolerances inevitable within the system allow the forward (secondary) cartridge, which may weigh as much as 30 kg, to continue down the chamber under its own inertia until halted by the chamber forcing cone, which can produce considerable stress on any connector, and lead to damage to either the connector or the body of the case.

The present invention is directed to the provision of a connectible two cartridge ammunition round which mitigates the above problems, and in particular to the provision of such a round which is compatible with autoloader systems in main battle tanks.

According to the present invention there is provided a two part ammunition round comprising a primary cartridge and a secondary cartridge, the two cartridges being loadable into a barrel so as to position a rear end of the secondary cartridge adjacent to a front end of the primary cartridge, wherein the rear end of the secondary cartridge and the front end of the primary cartridge are provided with mutually cooperable push fit connection engageable in a first engaged position when connection is effected under application of an axial compressive load to the round and in a second engaged position under application of an axial tensile load.

The connection of the two cartridges may be effected in the gun chamber or before loading the round into the gun chamber in an autoloader or manually. The configuration of the push fit connection means allows for some longitudinal translation to prevent excessive stresses from being generated in the connection means during loading, so that rapid round loading rates can be accomodated with reduced risk of round damage. Extraction of the round can generally be done more gently so that excessive axial tensile loads can be avoided and the above problem does not arise.

The connection of the cartridges when loaded in the barrel facilitates rapid downloading of the round in that withdrawal of the primary cartridge from the breech brings the secondary cartridge with it. Furthermore, a gun system may in practice be equipped with a range of two part rounds suitable for the engagement of varied targets, and connecting the cartridges will permit rapid withdrawal and replacement if the need arises to change the nature of the loaded round. The connecting means may conveniently be configured to be readily separable following removal of the round without damage to the cartridge cases by applying a bending stress, thus facilitating storage.

According to one embodiment of the invention, the connection means comprises at least one pair of connection members each pair consisting of a first connection member comprising a first socket and a second connection member comprising an axial projection complementarily engageable with the first socket to effect a push fit connection.

A capacity for translational movement between a first and second engaged position is then conveniently achieved when the first socket is provided with sufficient longitudinal depth to enable an axial projection to be engageable therein in a first position when connection is effected under application of an axial compressive load to the round and in a second position under application of an axial tensile load.

A push fit connection capability is preferably achieved when each axial projection comprises at its projecting end a connecting lug comprising at least one flexibly resilient lateral projection, and each first socket is provided at its mouth with a laterally projecting jaw member configured to be snap engageable with a connecting lug.

Each jaw member and each connecting lug are preferably complementarily chamfered to facilitate alignment during snap engagement. This ensures that minor misalignments as the two cartridges are brought together do not preclude successful, correctly aligned connection, which is of particular practical value when an autoloader is used to connect the round before loading.

Each axial projection is preferably provided with slots to facilitate deformation as a radial load develops during the connection process.

According to a further embodiment of the invention each connection means comprises at least one pair of connection members each pair provided with a detachable connecting piece, which connecting piece is engageable between a pair of connection members to effect a push fit connection. The use of a connection comprising one or more separate connecting pieces, rather than having connectors integral to the case, means that the chance of damage occurring in transit is reduced. Additionally, damage to an integral connector in storage or transit is liable to render the entire cartridge useless, whereas a separable connecting piece is easily and cheaply replaced. Moreover, connecting pieces can be stored separately, so that the stowage length required for hull-stored rounds can be reduced compared with the length of an equivalent round having a projecting connector integral to the case.

To exploit this feature to the full each connection member preferably does not project beyond the end of the cartridge case in which it is located. This offers the additional advantage that a pair of cartridges used without a connecting piece has an end profile compatible with systems which are not adapted to handle connected rounds.

Each connection member preferably comprises a socket complementarily engageable with an end of a connecting piece.

In this embodiment a capacity for translational movement between a first and second engaged position is then conveniently achieved when one socket of each pair is provided with sufficient longitudinal depth to enable a connecting piece to be engageable therein in a first position when connection is effected under application of an axial compressive load to the round and in a second position under application of an axial tensile load.

Each connecting piece preferably comprises a body member having at either end a connecting lug comprising at least one flexibly resilient lateral projection, and each socket is provided at its mouth with a laterally projecting jaw member configured to be snap engageable with a connecting lug.

For ease of connection of cartridges and connecting pieces it will generally be preferable that the connecting lugs at either end of a connecting piece are identical, so that it can be fitted either way. The complementary jaw members are consequently also identical.

In a complete ammunition system, it is likely to be desirable that all lugs and jaw members of a particular type of two part round are identical. However, a practical ammunition system may comprise more than one type of round (for example, rounds with a kinetic energy penetrator in the secondary cartridge and rounds with a high explosive charge in the secondary cartridge). In such cases it may be desirable to provide each round type with its own connector design in accordance with the invention, thus preventing mismatching of incompatible primary and secondary cartridges from different types of round.

Each jaw member and each connecting lug are preferably complementarily chamfered to facilitate alignment during snap engagement.

The connecting piece is preferably slotted to facilitate a reduction in diameter of the connecting piece body member under radial compressive loading. For simplicity of alignment it is preferable that the connection has circular cross section, so the connecting piece body member is preferably a transversely slotted cylinder, and each socket therefore preferably defines a cylindrical cavity having a jaw member comprising an annular projection.

The sockets are preferably manufactured of a different material, of higher mechanical strength and toughness, than the bulk of the casing which can then be of combustible material. The connecting piece and sockets are most preferably constructed from a plastics material, which allows for cheap mass production using known techniques. Use of such a material will also minimize the risk of pieces from the connection means causing damage to the barrel during its ejection from the muzzle after firing.

The plastics material requires strength with flexibility throughout the desired range of operational temperatures, and should ideally have self lubricating properties to assist in deformation and separation of the connector. Suitable materials include nylon and PTFE.

Whether connection is effected via a socket and projection arrangement or via a separable connecting piece, the connection means preferably comprises one pair of connection members.

The invention will now be described by way of example only with reference to FIGS. 1, 2 and 3 in which.

Figure 1:
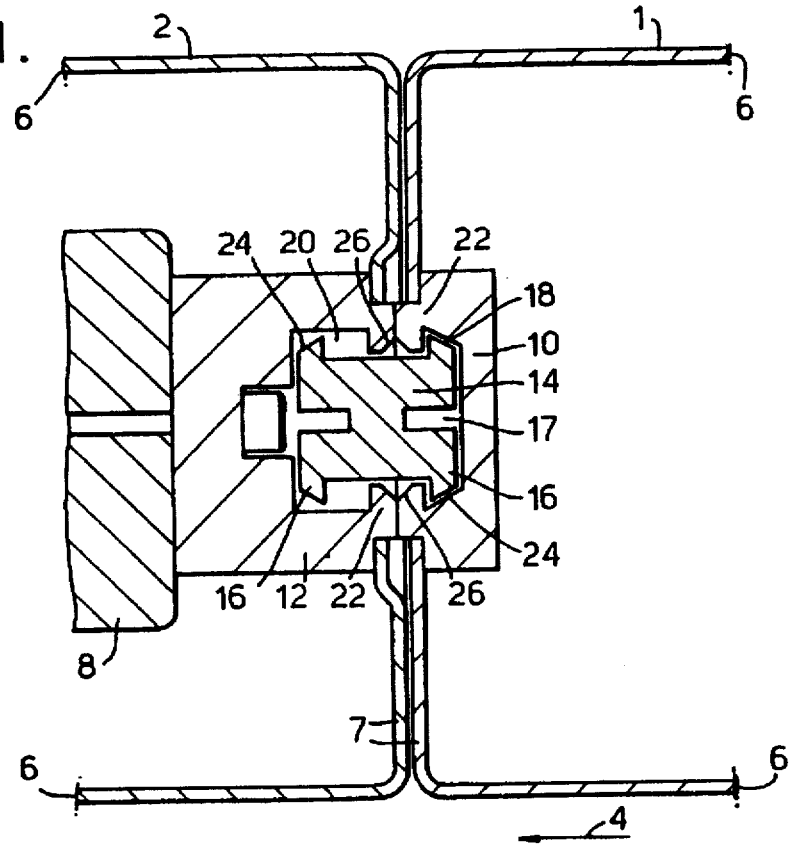
FIG. 1 is a transverse cross section of an ammunition round according to an embodiment of the invention during loading into a gun barrel.

FIG. 1 illustrates a primary cartridge 1 and a secondary cartridge 2 according to an embodiment of the invention, as they would be configured when joined by a connector during loading into a barrel (not shown) by application of a ramming force to the primary cartridge 1 in the direction of the arrow 4. Each cartridge 1, 2 comprises a case 6 of combustible material containing propellant (not shown), with the secondary cartridge 2 additionally containing a long rod penetrator 8. The primary cartridge incorporates a socket 10 and the secondary cartridge a socket 12, which together contain and are connected by a connecting piece 14. The connecting piece 14 is manufactured from PTFE to give else of manufacture combined with good mechanical flexibility throughout a design operating temperature range of −46° C. to +71° C. The sockets 10, 12 do not require the same degree of flexibility, and other plastics such as nylon may therefore be suitable for these components even for operation at the lower end of this temperature range.

At either end of the connecting piece 14 is a laterally protruding rim 16 which in the connected position, as shown, lies within cavities 18, 20 within the sockets 10, 12. At the mouth of each cavity 18, 20 is an area of reduced diameter which constitutes a jaw member 22. The components are joined by applying an axial load in the direction of the arrow 4, so as to bring the rims 16 and jaws 22 into contact. A snap connection is effected as surfaces 24 of the rims 16 engage corresponding surfaces 26 of the jaws 22 and deform elastically under load until they are able to pass through the jaws 22, at which point they expand elastically into the cavities 18, 20. The connecting piece 14 is provided with slots 17 which facilitate a reduction in diameter of the connecting piece body under the radial compressive loading which results from the interaction of jaws and rims during connection, thus aiding the connection process. To facilitate alignment of the components the surfaces 26 and 22 are complementarily chamfered. The connecting piece 14 is retained in position by engagement of a surface of a rim 16 against a complementary face of the jaw 22.

During loading ramming forces are transmitted primarily through sockets and cases rather than through the connecting piece 14. The sockets 10, 12 and casings 6 are configured such that during loading the faces 7 of the casings 6 are brought into contact to spread the load over substantially all the surface area and minimize shearing forces at the casing/socket interface. Additionally, the cavity 20 in the socket 12 located in the secondary cartridge 2 has a longitudinal depth sufficient to allow some axial movement of the rim 16 contained within. This allows for limited forward movement of the secondary cartridge 2 in the direction of the arrow 4 once the primary cartridge 1 is stopped in the loaded position, such as must inevitably arise due to barrel and ammunition tolerances, without producing a strain in the connecting piece 14. Thus, the connecting piece 14 is substantially unstrained throughout the loading procedure.

Figure 2:
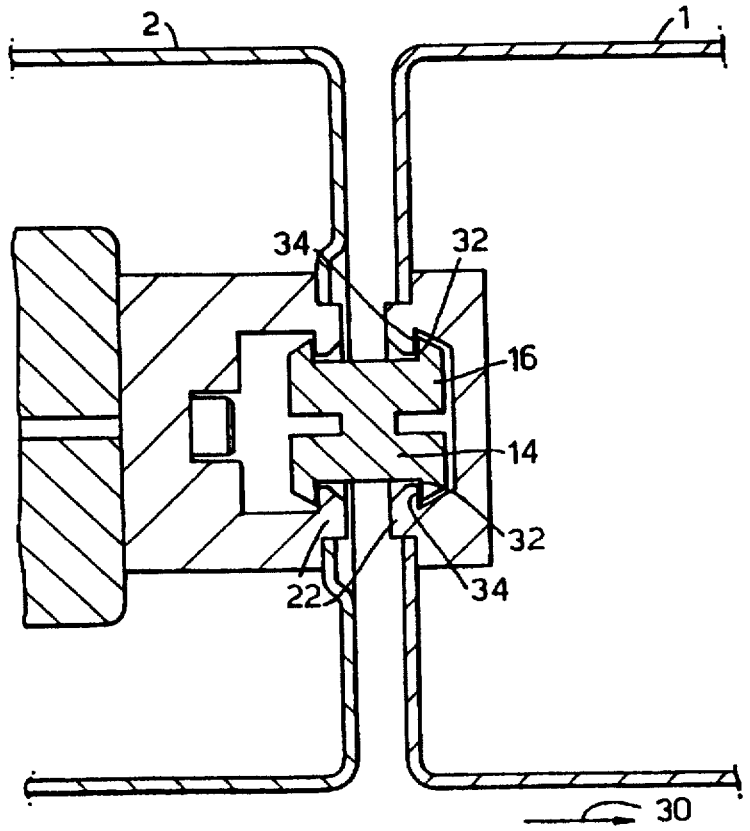
FIG. 2 is a is a transverse cross section of the ammunition round of FIG. 1 during unloading from a gun barrel.

The situation during unloading is shown in FIG. 2. In this case a withdrawing force is applied to the primary cartridge 1 in the direction of the arrow 30, and acts via the connecting piece 14 to withdraw the secondary cartridge 2 simultaneously. The force is transmitted by engagement of surfaces 32 of the rims 16 with complementary surfaces 34 of the jaws 22. However, the unloading process can be more controlled than loading, and the withdrawing force can be kept at levels which ensure strain in the connecting piece 14 does not become unacceptably high.

Figure 3:
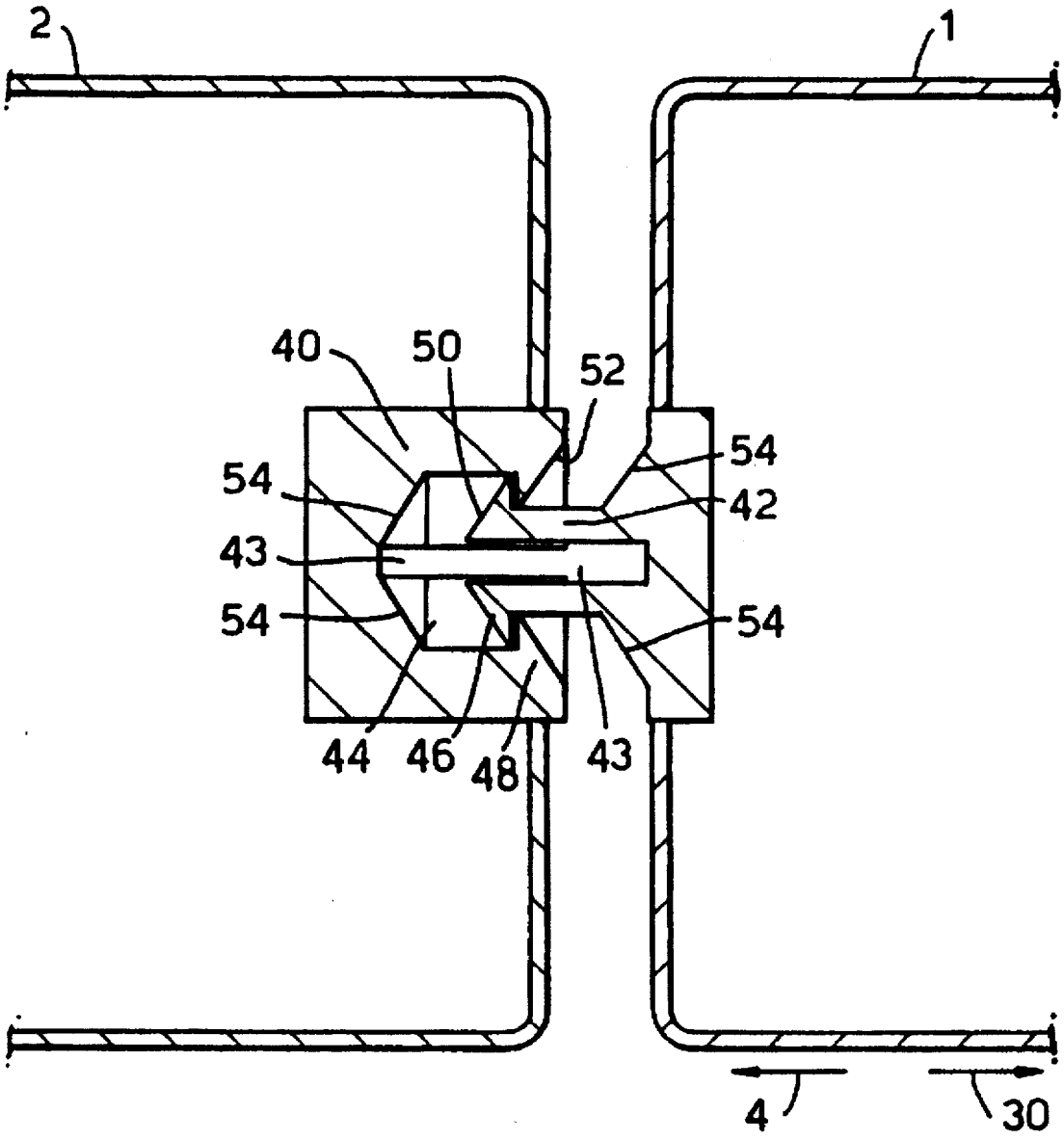
FIG. 3 is a transverse cross section of an ammunition round according to an alternative embodiment of the invention during loading into a gun barrel.

FIG. 3 illustrates a primary cartridge 1 and a secondary cartridge 2 according to an alternative embodiment of the invention, as they would be configured during unloading. The cartridges 1, 2 are similarly constructed to those of the round above described and like numerals are used to denote like components.

Each cartridge incorporates an axially projecting cylindrical connection member 40, 42. The connection member 42 is of smaller diameter, and the connection member 40 is hollow, providing a cavity 44 to accommodate the connection member 42 when connected, and thereby serving an equivalent function to the sockets of the earlier embodiment. At the free end of the connection member 42 is a laterally protruding rim 46 which in the connected position, as shown, lies within the cavity 44 described by the connection member 40. At the mouth of the cavity 44 is an area of reduced diameter which constitutes a jaw member 48. The components are joined by applying an axial load in the direction of the arrow 4, so as to bring the rims 46 and jaws 48 into contact. A snap connection is effected as before. Both connecting members 40, 42 are provided with slots 43 which facilitate deformation under the radial loading which results from the interaction of jaws and rims during connection, thus aiding the connection process. To facilitate alignment of the components the surfaces 50 and 52 of the rim 46 and jaws 48 are complementarily chamfered as in the previous embodiment.

During loading of the round ramming forces are transmitted through the connection means via surfaces 50, 52 and complementary surfaces 54. The cavity 44 is configured to allow axial movement from this position to the withdrawing position (as illustrated). A withdrawing force is being applied to the primary cartridge 1 in the direction of the arrow 30, and acts via the connection members 40, 42 to withdraw the secondary cartridge 2 simultaneously as before.

I claim:

1. Two part ammunition round comprising:

a primary cartridge;

a secondary cartridge, the two cartridges being loadable into a barrel so as to position a rear end of the secondary cartridge adjacent to a front end of the primary cartridge; and a mutually cooperable push fit connection engaging said rear end of said secondary cartridge and said front end of said primary cartridge in a first engaged position when connection is effected under application of an axial compressive load to the round and in a second engaged position under application of an axial tensile load, said push fit connection permitting relative longitudinal movement between said primary and secondary cartridges.

2. Ammunition round according to claim 1 wherein the connection comprises at least one pair of connection members each pair consisting of a first connection member comprising a first socket and a second connection member comprising an axial projection complementarily engageable with the first socket to effect a push fit connection.

3. Ammunition round according to claim 2 wherein each first socket is provided with sufficient longitudinal depth to enable an axial projection to be engageable therein in a first position when connection is effected under application of an axial compressive load to the round and in a second position under application of an axial tensile load.

4. Ammunition round according to claim 2 wherein each axial projection comprises at its projecting end a connecting lug comprising at least one flexibly resilient lateral projection, and each first socket is provided at its mouth with a laterally projecting jaw member configured to be snap engageable with a connecting lug.

5. Ammunition round according to claim 4 wherein each jaw member and each connecting lug are complementarily chamfered to facilitate alignment during snap engagement.

6. Ammunition round according to claim 2 wherein each axial projection is provided with slots to facilitate deformation as a radial load develops during the connection process.

7. Ammunition round according to claim 1 wherein the connection means comprises at least one pair of connection members each pair provided with a detachable connecting piece, which connecting piece is engageable between a pair of connection members to effect a push fit connection.

8. Ammunition round according to claim 7 wherein each connection member comprises a socket complementarily engageable with an end of said connecting piece.

9. Ammunition round according to claim 8 wherein one socket of each pair is provided with sufficient longitudinal depth to enable a connecting piece to be engageable therein in a first position when connection is effected under application of an axial compressive load to the round and in a second position under application of an axial tensile load.

10. Ammunition round according to claim 8 wherein each connecting piece comprises a body member having two ends and at each end a connecting lug comprising at least one flexibly resilient lateral projection, and each socket is provided at its mouth with a laterally projecting jaw member configured to be snap engageable with a connecting lug.

11. Ammunition round according to claim 10 wherein the connecting lugs at either end of a connecting piece are identical.

12. Ammunition round according to claim 10 wherein each jaw member and each connecting lug are complementarily chamfered to facilitate alignment during snap engagement.

13. Ammunition round according to claim 8 wherein each connecting piece body member is a transversely slotted cylinder and each socket defines a cylindrical cavity having a jaw member comprising an annular projection.

14. Ammunition round according to claim 2 wherein the connection means comprises one pair of connection members.

* * * * *

UNITED STATES PATENT AND TRADEMARK OFFICE

CERTIFICATE OF CORRECTION

PATENT NO. : 5,714,710
DATED : February 3, 1998
INVENTOR(S) : ROACH

It is certified that error appears in the above-identified patent and that said letters patent is hereby corrected as shown below:

In the Title on the Cover Page, Item [54], delete "CHANGE" and insert --CHARGE--.

Column 1, line 1, delete "CHANGE" and insert --CHARGE--.

Signed and Sealed this
Second Day of June, 1998

*Attest:*

*Attesting Officer*

Bruce Lehman

BRUCE LEHMAN

*Commissioner of Patents and Trademarks*